US008783387B2

(12) United States Patent
Durairajan et al.

(10) Patent No.: US 8,783,387 B2
(45) Date of Patent: Jul. 22, 2014

(54) CUTTER GEOMETRY FOR HIGH ROP APPLICATIONS

(75) Inventors: Bala Durairajan, Houston, TX (US); Carl M. Hoffmaster, Houston, TX (US)

(73) Assignee: Smith International, Inc., Houston, TX (US)

( * ) Notice: Subject to any disclaimer, the term of this patent is extended or adjusted under 35 U.S.C. 154(b) by 822 days.

(21) Appl. No.: 12/205,778

(22) Filed: Sep. 5, 2008

(65) Prior Publication Data

US 2010/0059287 A1 Mar. 11, 2010

(51) Int. Cl.
*E21B 10/36* (2006.01)

(52) U.S. Cl.
USPC ..... 175/430; 175/426; 175/428

(58) Field of Classification Search
USPC ..... 175/426, 428, 430
See application file for complete search history.

(56) References Cited

U.S. PATENT DOCUMENTS

| | | | | | |
|---|---|---|---|---|---|
| 3,745,623 | A | | 7/1973 | Wentorf, Jr. et al. | |
| 4,593,777 | A | | 6/1986 | Barr et al. | |
| 4,705,122 | A | * | 11/1987 | Wardley et al. | 175/430 |
| 4,724,913 | A | * | 2/1988 | Morris | 175/430 |
| 4,872,520 | A | | 10/1989 | Nelson | |
| 4,984,642 | A | | 1/1991 | Renard et al. | |
| 5,025,874 | A | | 6/1991 | Barr et al. | |
| 5,314,033 | A | | 5/1994 | Tibbitts | |
| 5,332,051 | A | | 7/1994 | Knowlton | |
| 5,377,773 | A | | 1/1995 | Tibbitts | |
| 5,379,853 | A | | 1/1995 | Lockwood et al. | |
| 5,383,527 | A | * | 1/1995 | Azar | 175/431 |
| 5,437,343 | A | | 8/1995 | Cooley et al. | |
| 5,460,233 | A | | 10/1995 | Meany et al. | |
| 5,467,836 | A | | 11/1995 | Grimes et al. | |
| 5,706,906 | A | | 1/1998 | Jurewicz et al. | |
| 5,740,874 | A | * | 4/1998 | Matthias | 175/430 |
| 5,881,830 | A | | 3/1999 | Cooley | |
| 5,928,071 | A | | 7/1999 | Devlin | |
| 6,003,623 | A | | 12/1999 | Miess | |
| 6,009,963 | A | * | 1/2000 | Chaves et al. | 175/432 |
| 6,045,440 | A | * | 4/2000 | Johnson et al. | 451/540 |
| 6,065,554 | A | * | 5/2000 | Taylor et al. | 175/430 |
| 6,202,770 | B1 | | 3/2001 | Jurewicz et al. | |
| 6,241,035 | B1 | * | 6/2001 | Portwood | 175/374 |
| 6,367,568 | B2 | * | 4/2002 | Steinke et al. | 175/331 |
| 6,550,556 | B2 | | 4/2003 | Middlemiss et al. | |
| 6,604,588 | B2 | | 8/2003 | Eyre et al. | |
| 6,672,406 | B2 | | 1/2004 | Beuershausen | |
| 6,904,983 | B2 | | 6/2005 | Thigpen et al. | |
| 6,904,984 | B1 | | 6/2005 | Estes et al. | |
| 6,929,079 | B2 | * | 8/2005 | McDonough et al. | 175/420.1 |
| 7,140,448 | B2 | | 11/2006 | Estes et al. | |
| 7,681,673 | B2 | * | 3/2010 | Kolachalam | 175/430 |
| 8,061,456 | B2 | * | 11/2011 | Patel et al. | 175/430 |
| 2005/0247492 | A1 | | 11/2005 | Shen et al. | |
| 2006/0283639 | A1 | | 12/2006 | Yong et al. | |
| 2008/0053710 | A1 | * | 3/2008 | Moss | 175/426 |

* cited by examiner

*Primary Examiner* — Jennifer H Gay
*Assistant Examiner* — Elizabeth Gitlin
(74) *Attorney, Agent, or Firm* — Osha Liang LLP

(57) ABSTRACT

A polycrystalline diamond compact ("PDC")cutter includes a cylindrical body formed from a substrate material, an ultra-hard layer disposed on the cylindrical body, and a cutting face perpendicular to an axis of the cylindrical body, wherein the cutting face includes two or more lobes and wherein the radius of at least one lobe is between 50 and 90 percent of the radius of the cylindrical body. A PDC cutter includes a substrate, and a cutting face perpendicular to an axis of the substrate, wherein the cross-section of the cutting face comprises multiple lobes, and the cross-section of the substrate is substantially circular.

16 Claims, 6 Drawing Sheets

CUTTER GEOMETRY FOR HIGH ROP APPLICATIONS

BACKGROUND OF INVENTION

1. Field of the Invention

Embodiments disclosed herein generally relate to fixed cutter or PDC drill bits used to drill wellbores through earth formations. More specifically, embodiments disclosed herein relate to a PDC cutter of a PDC drill bit.

2. Background Art

Rotary drill bits with no moving elements on them are typically referred to as "drag" bits or fixed cutter drill bits. Drag bits are often used to drill a variety of rock formations. Drag bits include those having cutters (sometimes referred to as cutter elements, cutting elements, polycrystalline diamond compact ("PDC") cutters, or inserts) attached to the bit body. For example, the cutters may be formed having a substrate or support stud made of carbide, for example tungsten carbide, and an ultra hard cutting surface layer or "table" made of a polycrystalline diamond material or a polycrystalline boron nitride material deposited onto or otherwise bonded to the substrate at an interface surface.

An example of a prior art drag bit having a plurality of cutters with ultra hard working surfaces is shown in FIG. 1. The drill bit 10 includes a bit body 12 and a plurality of blades 14 that are formed on the bit body 12. The blades 14 are separated by channels or gaps 16 that enable drilling fluid to flow between and both clean and cool the blades 14 and cutters 18. Cutters 18 are held in the blades 14 at predetermined angular orientations and radial locations to present working surfaces 20 with a desired back rake angle against a formation to be drilled. The working surfaces 20 are generally perpendicular to the axis 19 and side surface 21 of a cylindrical cutter 18. Thus, the working surface 20 and the side surface 21 meet or intersect to form a circumferential cutting edge 22.

Nozzles 23 are typically formed in the drill bit body 12 and positioned in the gaps 16 so that fluid can be pumped to discharge drilling fluid in selected directions and at selected rates of flow between the cutting blades 14 for lubricating and cooling the drill bit 10, the blades 14, and the cutters 18. The drilling fluid also cleans and removes cuttings as the drill bit rotates and penetrates the geological formation. The gaps 16, which may be referred to as "fluid courses," are positioned to provide additional flow channels for drilling fluid and to provide a passage for cuttings to travel past the drill bit 10 toward the surface of a wellbore (not shown).

The drill bit 10 includes a shank 24 and a crown 26. Shank 24 is typically formed of steel or a matrix material and includes a threaded pin 28 for attachment to a drill string. Crown 26 has a cutting face 30 and outer side surface 32. The particular materials used to form drill bit bodies are selected to provide adequate toughness, while providing good resistance to abrasive and erosive wear. For example, in the case where an ultra hard cutter is to be used, the bit body 12 may be made from powdered tungsten carbide (WC) infiltrated with a binder alloy within a suitable mold form. In one manufacturing process the crown 26 includes a plurality of holes or pockets 34 that are sized and shaped to receive a corresponding plurality of cutters 18.

The combined plurality of surfaces 20 of the cutters 18 effectively forms the cutting face of the drill bit 10. Once the crown 26 is formed, the cutters 18 are positioned in the pockets 34 and affixed by any suitable method, such as brazing, adhesive, mechanical means such as interference fit, or the like. The design depicted provides the pockets 34 inclined with respect to the surface of the crown 26. The pockets 34 are inclined such that cutters 18 are oriented with the working face 20 at a desired rake angle in the direction of rotation of the bit 10, so as to enhance cutting. It will be understood that in an alternative construction (not shown), the cutters can each be substantially perpendicular to the surface of the crown, while an ultra hard surface is affixed to a substrate at an angle on a cutter body or a stud so that a desired rake angle is achieved at the working surface.

A typical cutter 18 is shown in FIG. 2. The typical cutter 18 has a cylindrical cemented carbide substrate body 38 having an end face or upper surface 54 referred to herein as the "interface surface" 54. An ultrahard material layer (cutting layer) 44, such as polycrystalline diamond or polycrystalline cubic boron nitride layer, forms the working surface 20 and the cutting edge 22. A bottom surface 52 of the ultrahard material layer 44 is bonded on to the upper surface 54 of the substrate 38. The bottom surface 52 and the upper surface 54 are herein collectively referred to as the interface 46. The top exposed surface or working surface 20 of the cutting layer 44 is opposite the bottom surface 52. The cutting layer 44 typically has a flat or planar working surface 20, but may also have a curved exposed surface, that meets the side surface 21 at a cutting edge 22.

Cutters may be made, for example, according to the teachings of U.S. Pat. No. 3,745,623, whereby a relatively small volume of ultra hard particles such as diamond or cubic boron nitride is sintered as a thin layer onto a cemented tungsten carbide substrate. Flat top surface cutters as shown in FIG. 2 are generally the most common and convenient to manufacture with an ultra hard layer according to known techniques. It has been found that cutter chipping, spalling and delamination are common failure modes for ultra hard flat top surface cutters.

Generally speaking, the process for making a cutter 18 employs a body of tungsten carbide as the substrate 38. The carbide body is placed adjacent to a layer of ultra hard material particles such as diamond or cubic boron nitride particles and the combination is subjected to high temperature at a pressure where the ultra hard material particles are thermodynamically stable. This results in recrystallization and formation of a polycrystalline ultra hard material layer, such as a polycrystalline diamond or polycrystalline cubic boron nitride layer, directly onto the upper surface 54 of the cemented tungsten carbide substrate 38.

Different types of bits are generally selected based on the nature of the geological formation to be drilled. Drag bits are typically selected for relatively soft formations such as sands, clays and some soft rock formations that are not excessively hard or excessively abrasive. However, selecting the best bit is not always straightforward because many formations have mixed characteristics (i.e., the geological formation may include both hard and soft zones), depending on the location and depth of the well bore. Changes in the geological formation can affect the desired type of a bit, the desired rate of penetration (ROP) of a bit, the desired rotation speed, and the desired downward force or weight-on-bit ("WOB"). Where a drill bit is operated outside the desired ranges of operation, the bit can be damaged or the life of the bit can be severely reduced, For example, a drill bit normally operated in one general type of formation may penetrate into a different formation too rapidly or too slowly subjecting it to too little load or too much load. For another example, a drill bit rotating and penetrating at a desired speed may encounter an unexpectedly hard formation material, possibly subjecting the bit to a "surprise" or sudden impact force. A formation material that is softer than expected may result in a high rate of rotation, a high ROP, or both, thereby causing the cutters to shear too deeply or to gouge into the geological formation.

This can place greater loading, excessive shear forces, and added heat on the working surface of the cutters. Rotation speeds that are too high without sufficient WOB, for a particular drill bit design in a given formation, can also result in detrimental instability (bit whirling) and chattering because the drill bit cuts too deeply or intermittently bites into the geological formation. Cutter chipping, spalling, and delamination, in these and other situations, are common failure modes for ultra hard flat top surface cutters.

Dome top cutters, which have dome-shaped top surfaces, have provided certain benefits against gouging and the resultant excessive impact loading and instability. This approach for reducing adverse effects of flat surface cutters is described in U.S. Pat. No. 5,332,051. An example of such a dome cutter in operation is depicted in FIG. 3. The prior art cutter 60 has a dome shaped top or working surface 62 that is formed with an ultra hard layer 64 bonded to a substrate 66. The substrate 66 is bonded to a metallic stud 68. The cutter 60 is held in a blade 70 of a drill bit 72 (shown in partial section) and engaged with a geological formation 74 (also shown in partial section) in a cutting operation. The dome shaped working surface 62 effectively modifies the rake angle A that would be produced by the orientation of the cutter 60.

Scoop top cutters, as shown in U.S. Pat. No. 6,550,556, have also provided some benefits against the adverse effects of impact loading. This type of prior art cutter is made with a "scoop" or depression formed in the top working surface of an ultra hard layer. The ultra hard layer is bonded to a substrate at an interface. The depression is formed in the critical region. The upper surface of the substrate has a depression corresponding to the depression, such that the depression does not make the ultra hard layer too thin. The interface may be referred to as a non-planar interface (NPI).

Beveled or radiused cutters have provided increased durability for rock drilling. U.S. Pat. Nos. 6,003,623 and 5,706,906 disclose cutters with radiused or beveled side wall. This type of prior art cutter has a cylindrical mount section with a cutting section, or diamond cap, formed at one of its axial ends. The diamond cap includes a cylindrical wall section. An annular, arc surface (radiused surface) extends laterally and longitudinally between a planar end surface and the external surface of the cylindrical wall section. The radiused surface is in the form of a surface of revolution of an arc line segment that is concave relative to the axis of revolution.

While conventional PDC cutters have been designed to increase the durability for rock drilling, cutting efficiency usually decreases. The cutting efficiency decreases as a result of the cutter dulling, thereby increasing the weight-bearing area. As a result, more WOB must be applied. The additional WOB generates more friction and heat and may result in spalling or cracking of the cutter. Additionally, ROP of the cutter may be decreased.

Accordingly, there exists a need for a cutting structure for a PDC drill bit with increased rate of penetration.

SUMMARY OF INVENTION

In one aspect, embodiments disclosed herein relate to a PDC cutter including a cylindrical body formed from a substrate material, an ultrahard layer disposed on the cylindrical body, and a cutting face perpendicular to an axis of the cylindrical body, wherein the cutting face includes two or more lobes and wherein the radius of at least one lobe is between 50 and 90 percent of the radius of the cylindrical body.

In another aspect, embodiments disclosed herein relate to a PDC cutter including a cylindrical body formed from a substrate material, an ultrahard layer disposed on the cylindrical body, and a cutting face perpendicular to an axis of the cylindrical body having an irregular cross-section, wherein a chord of the cutting face is smaller than a corresponding chord of the cylindrical body.

In another aspect, embodiments disclosed herein relate to a PDC cutter including a substrate, an ultrahard layer disposed on the substrate, and a cutting face formed at a distal end of the ultrahard layer, wherein a perimeter of the cutting face comprises at least two convex portions and at least two concave portions with respect to an axis of the substrate.

In yet another aspect, embodiments disclosed herein relate to a PDC cutter including a substrate, and a cutting face perpendicular to an axis of the substrate, wherein the cross-section of the cutting face comprises multiple lobes, and the cross-section of the substrate is substantially circular.

Other aspects and advantages of the invention will be apparent from the following description and the appended claims.

DETAILED DESCRIPTION

In one aspect, embodiments disclosed herein generally relate to fixed cutter or PDC drill bits used to drill wellbores through earth formations. More specifically, embodiments disclosed herein relate to a PDC cutter of a PDC drill bit.

Figure 4:
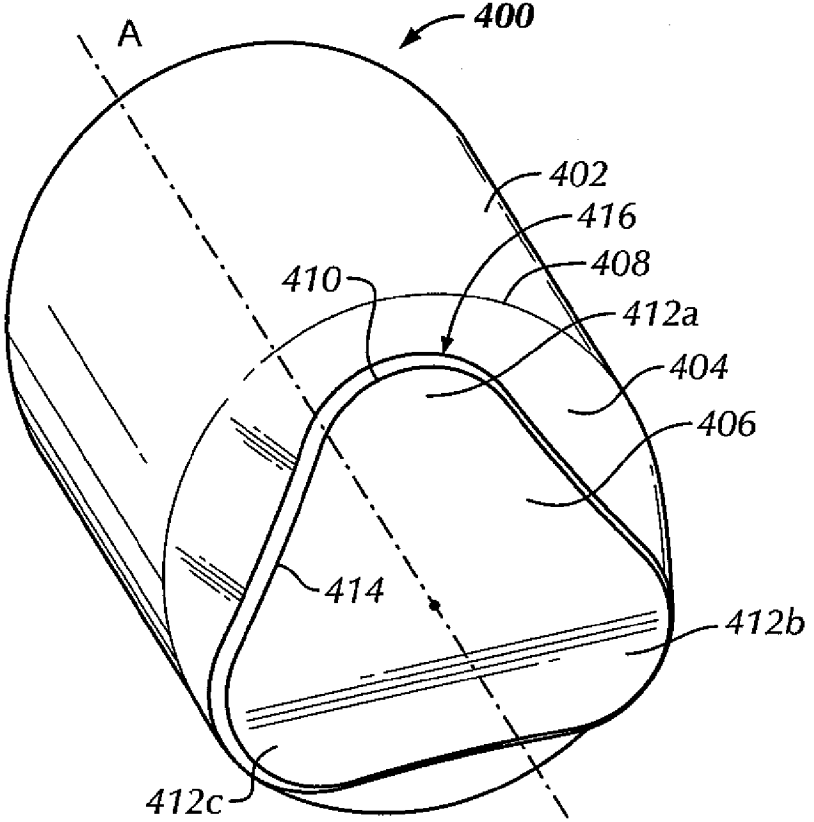
FIG. 4 is a perspective view of a PDC cutter in accordance with embodiments disclosed herein.

Referring to FIG. 4, a PDC cutter 400 is shown. PDC cutter 400 includes a body 402 and an ultrahard layer 404 disposed thereon. A cutting face 406 is formed perpendicular to a longitudinal axis A of the body 402 at a distal end of the ultrahard layer 404. Body 402 may be formed from any substrate material known in the art, for example, cemented tungsten carbide. Ultrahard layer 404 may be formed from any ultrahard material known in the art, for example, polycrystalline diamond or polycrystalline cubic boron nitride. A bottom surface (not shown) of the ultrahard material layer 404 is bonded on to an upper surface (not shown) of the body 402. The surface junction between the bottom surface and the upper surface are herein collectively referred to as interface 408. The cutting face 406 is opposite the bottom surface of the ultrahard layer 404. The cutting face 406 typically has a flat or planar surface.

As shown, body 402 is generally cylindrical along longitudinal axis A; however, cutting face 406 is non-cylindrical. Cutting face 406 includes two or more lobes 412. As used herein, a lobe is a rounded or somewhat rounded portion, projection, or division. Thus, as shown in FIG. 4, cutting face 406 includes three lobes 412, thereby forming a curved triangular-like cross-section. One of ordinary skill in the art will appreciate that a cutting face in accordance with embodiments disclosed herein may include two lobes, thereby forming an oval-like cross-section. In still other embodiments, the cutting face may include four lobes, thereby forming a curved square-like cross-section. The PDC cutter 400 may be positioned in a fixed cutter drill bit such that one of the lobes 412 contacts the formation in the direction of drilling. Thus, a first lobe 412*a* contacting the formation in the direction of drilling may be called a cutting tip 416. Once the first lobe 412*a* is worn, the PDC cutter may be removed and rotated, so as to move a second lobe 412*b* or a third lobe 412*c* into contact with the formation during drilling. Thus, each cutter 400 may be rotated one or more times depending on the number of lobes formed on the cutting face 406. Thus, after one lobe has been worn, another lobe may be moved into contact with the formation, thereby reducing the number of times the cutter must be replaced. This process may occur during remanufacturing or repair operations between runs of the drill bit.

As shown in FIG. 4, the cross-section of ultrahard layer 404 varies along longitudinal axis A. In particular, the cross-sectional area of the ultrahard layer 404 increases with the axial distance from the cutting face 406 toward the body 402. As shown, the cross-sectional area of the ultrahard layer 404 at or near the cutting face 406 approximately equals the cross-sectional area of the cutting face 406, while the cross-sectional area of the ultrahard layer 404 at or near the upper surface (not shown) of the body 402 approximately equals the cross-sectional area of the body 402. Thus, the cross-section, and therefore cross-sectional area, of the ultrahard layer 404 transitions from a non-cylindrical cross-section to a cylindrical cross-section along the length of the PDC cutter 400.

Figure 5:
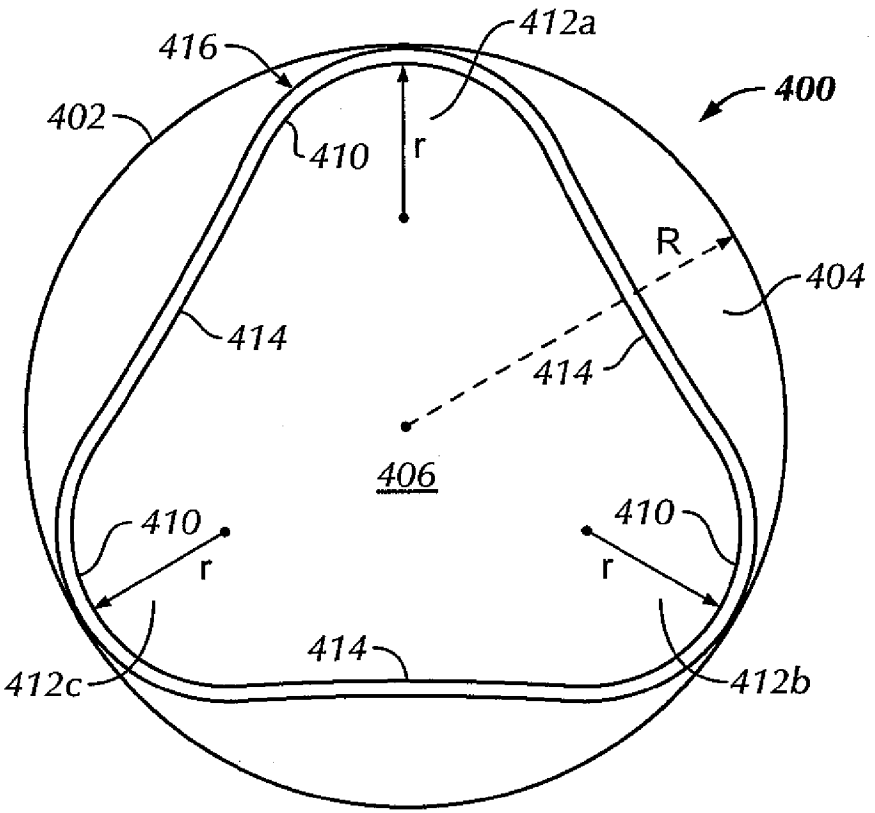
FIG. 5 is an end view of the PDC cutter of FIG. 4.

Referring now to FIG. 5, an end view of the PDC cutter 400 of FIG. 4 is shown. A perimeter of the cutting face 406, as shown, includes three concave portions 410, thereby defining three lobes 412. The concave portions 410 are joined by convex or slightly convex portions 414. In some embodiments, concave portions 410 may be joined by substantially straight portions (not shown). Those of ordinary skill in the art will appreciate that while the PDC cutter shown in FIG. 5 includes a cutting face 406 with three lobes 412, a cutting face in accordance with embodiments of the present disclosure may include two lobes, having two concave portions and two convex or substantially straight sections, four lobes, having four concave portions and four convex or substantially straight sections, or more without departing from the scope of embodiments disclosed herein.

Still referring to FIG. 5, each lobe 412 of the cutting face 406 is defined by a radius, r. In one embodiment, the radius r of the lobe 412 is measured at the cutting tip 416 of the lobe in contact with the formation during drilling. The radius r of at least one lobe 412 is smaller than a radius, R, of the cylindrical body 402 of the cutter 400. In certain embodiments, the radius r of at least one lobe is between 50 and 90 percent of the radius of the body 402. In other embodiments, the radius r of at least one lobe is between 55 and 83 percent of the radius of the body 402. For example, a cutter formed in accordance with embodiments disclosed herein may include a cylindrical body with a radius R of 16 mm. An ultrahard layer is disposed on the cylindrical body and a cutting face is formed at a distal of the ultrahard layer, wherein the cutting face includes two or more lobes. In one example, at least one lobe has a radius r of 11 mm. Thus, the radius r of the lobe is approximately 69 percent of the radius R of they cylindrical body. In other examples, the cylindrical body may have a radius R of 16 mm, wherein the radius r of at least one lobe of the cutting face is 9 mm. Thus, the radius r of the lobe is approximately 56 percent of the radius R of the cylindrical body. In yet another example, the radius R of the cylindrical body is 16 mm and the radius r of at least one lobe of the cutting face is 13 mm. Thus, the radius r of the lobe is approximately 81 percent of the radius R of the cylindrical body. These examples are in accordance with embodiments of the present disclosure and are illustrative, not exhaustive. Accordingly, one of ordinary skill in the art will appreciate that the radius R of the body of the cutter may be varied and/or the radius r of at least one lobe may be varied, such that the ratio of the radius r of at least one lobe to the radius R of the body of the cutter is between approximately 50 and 90 percent.

Figure 1:
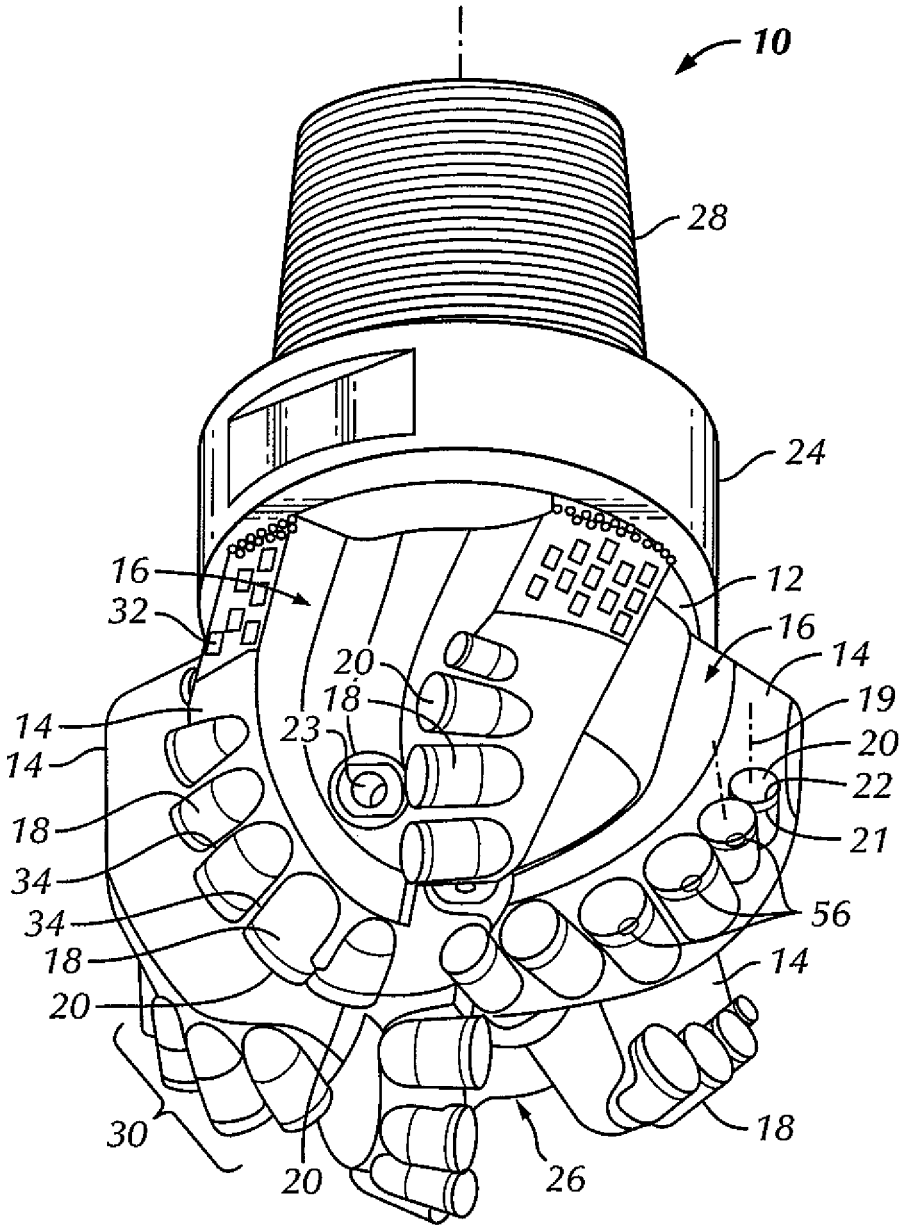
FIG. 1 (Prior Art)
FIG. 1 is a perspective view of a conventional fixed cutter drill bit.
Figure 2:
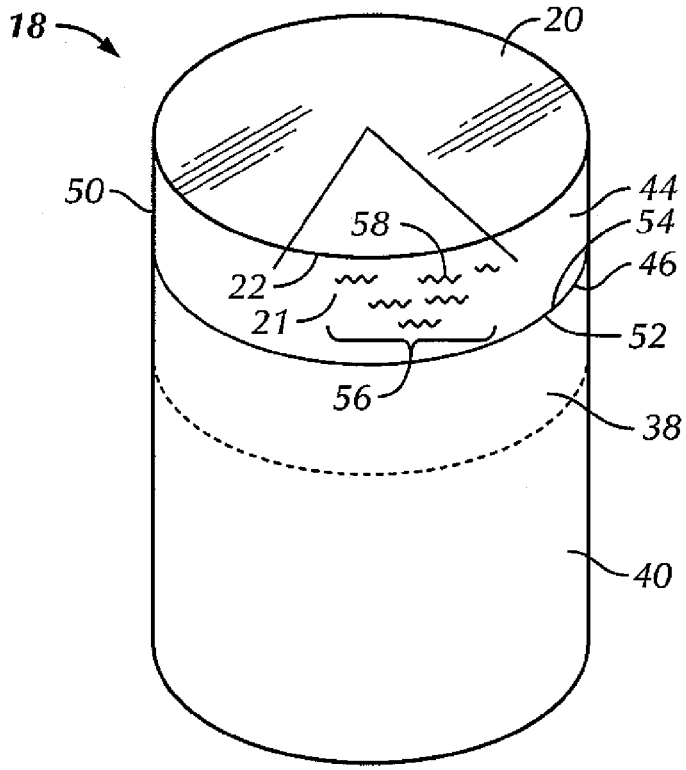
FIG. 2 (Prior Art)
FIG. 2 shows a conventional cutter for a fixed cutter drill bit.
Figure 3:
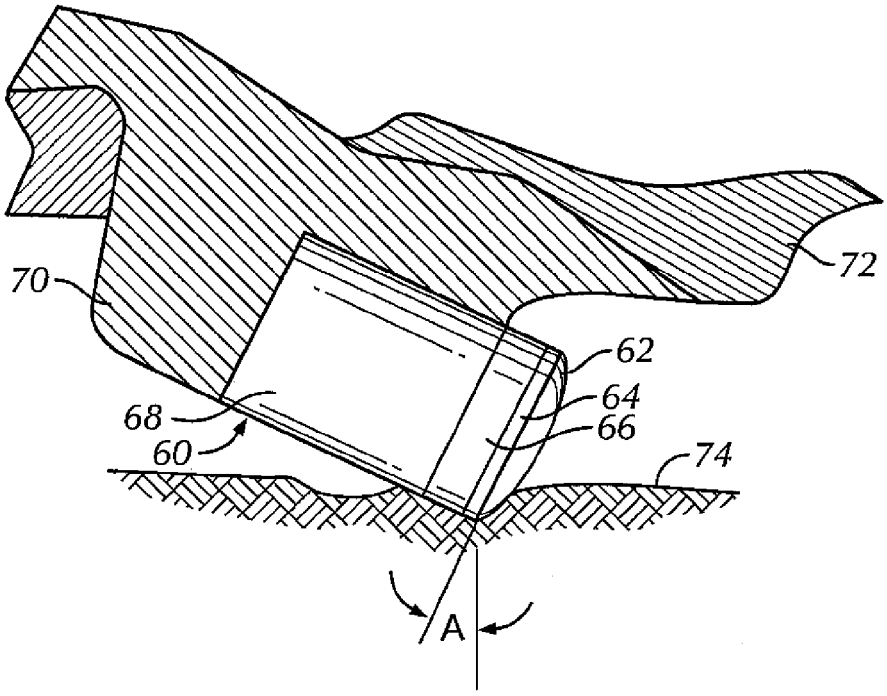
FIG. 3 (Prior Art)
FIG. 3 shows a conventional cutter of a fixed cutter drill bit engaging a formation.

The ultrahard layer 404 of the cutter 400 "blends" or transitions from the smaller radius r of the at least one lobe 412 of the cutting face 406 into the larger radius R of the body 402. Thus, the cross-section of the ultrahard layer 404 changes as the ultrahard layer 404 transitions from a non-cylindrical face to a cylindrical body. (See FIG. 4). This transition between cross-sections in the ultrahard layer 404 may be a smooth transition. The smaller radius r of the at least one lobe 412 in contact with the formation, i.e., the cutting tip 416, provides a wear surface with a width that does not increase as quickly as a conventional cutter, such as those illustrated in FIGS. 2 and 3.

Figure 7:
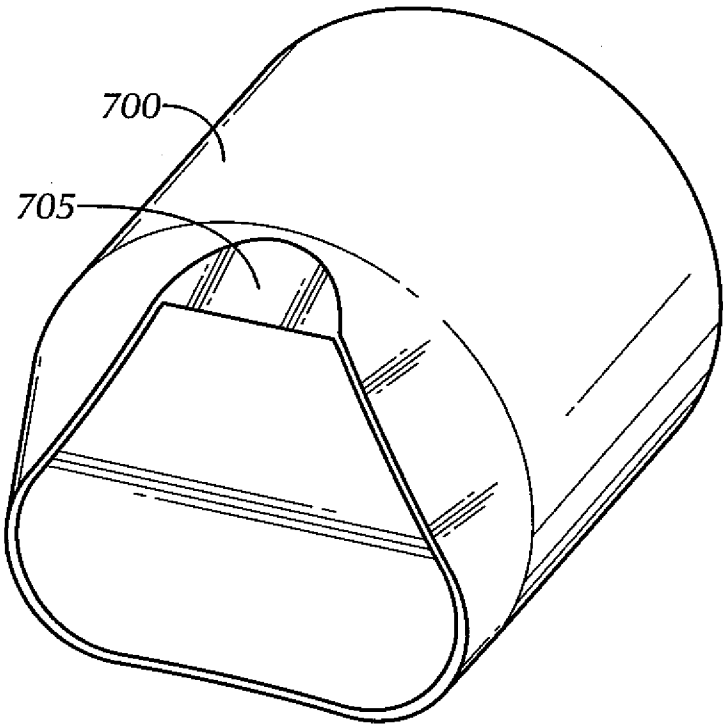
FIG. 7 shows a worn PDC cutter formed in accordance with embodiments disclosed herein.
Figure 6:
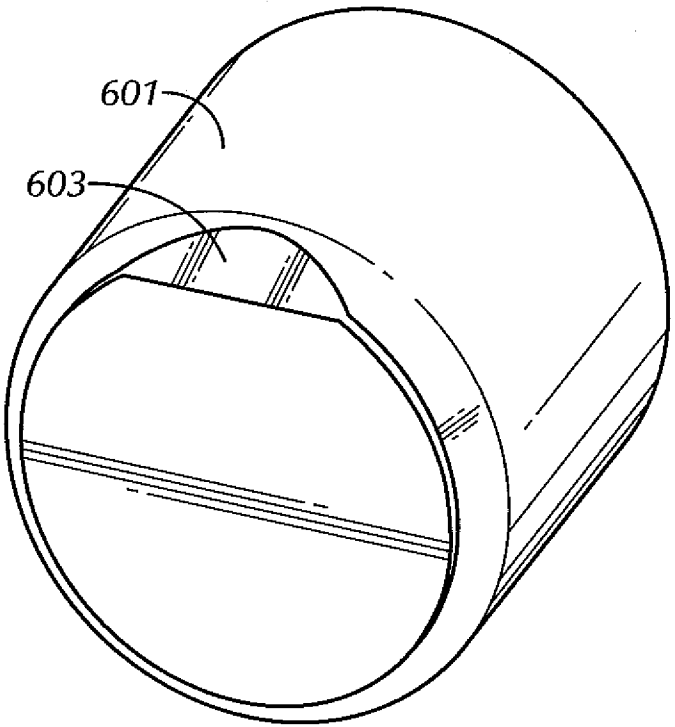
FIG. 6 (Prior Art)
FIG. 6 shows a worn conventional cutter.

Referring to FIGS. 6 and 7, a conventional cutter 601 and a cutter 700 formed in accordance with embodiments of the present disclose are shown, respectively. Wear of the conventional cutter 601 and the cutter 700 formed in accordance with embodiments of the present disclosure are determined and shown in FIGS. 6 and 7, respectively, with both cutters 601 and 700 disposed in contact with a formation at the same back rake angle and the same depth of cut. As used herein, back rack angle refers to the aggressiveness of the cutter and is defined by the angle between a cutter's face and a line perpendicular to the formation being drilled. One of ordinary skill in the art will appreciate that experimental tests and/or computer simulations of the cutters in contact with a formation may be performed to determine the wear rate and/or wear area of the cutters shown in FIGS. 6 and 7. As shown, a resulting wear flat area 603 of the conventional cutter 601 is larger than a wear flat area 705 of a cutter 700 formed in accordance with embodiments of the present disclosure. The smaller radius r of the lobe (412, FIG. 5) in contact with the formation of the cutter 700 formed in accordance with embodiments disclosed herein provides a wear surface that does not increase in width as quickly as the wear surface of a conventional cutter 601. Thus, the ROP of a cutter 700 formed in accordance with embodiments disclosed herein is much higher when initially in contact with a formation than a conventional cutter 601 in contact with a formation. Further, the ROP of a cutter 700 formed in accordance with the present disclosure is maintained during drilling of the formation. In other words, the ROP of the cutter 700 does not drop as quickly as a conventional cutter 601 during the life of the cutter.

Figure 9:
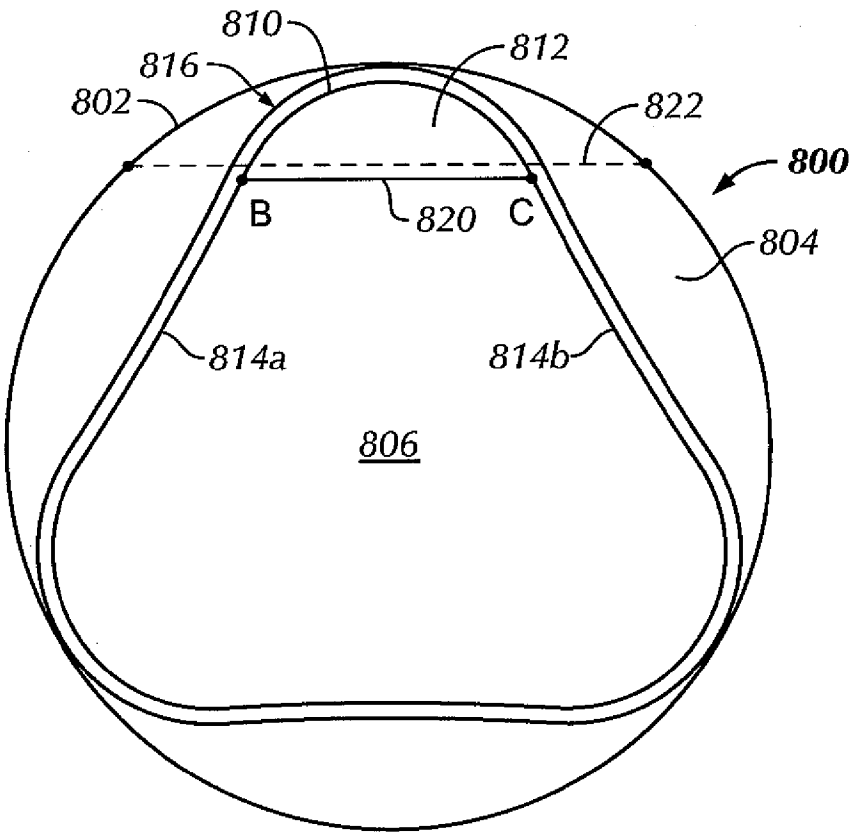
FIG. 9 is an end view of the PDC cutter of FIG. 8.
Figure 8:
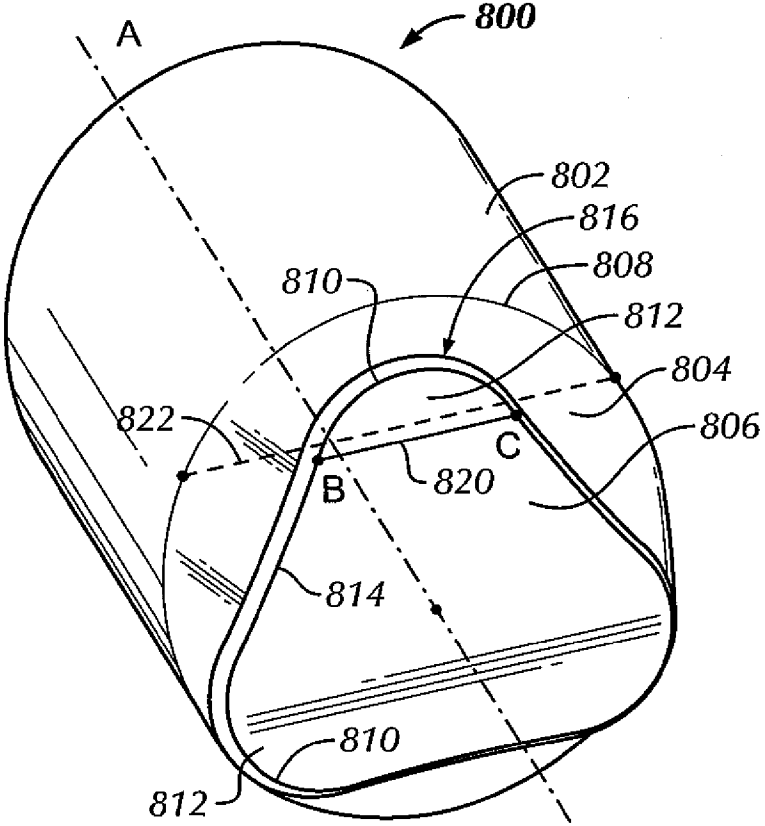
FIG. 8 is a perspective view of a PDC cutter in accordance with embodiments disclosed herein.

Referring now to FIGS. 8 and 9, a perspective view and an end view of a cutter 800 formed in accordance with embodiments of the present disclosure are shown, respectively. Cutter 800 includes a body 802 and an ultrahard layer 804 disposed thereon. A cutting face 806 is formed perpendicular to a longitudinal axis A of the body 802 at a distal end of the ultrahard layer 804. Body 802 may be formed from any substrate material known in the art, for example, cemented tungsten carbide. Ultrahard layer 804 may be formed from any ultrahard material known in the art, for example, polycrystalline diamond or polycrystalline cubic boron nitride. A bottom surface (not shown) of the ultrahard material layer 804 is bonded to an upper surface (not shown) of the body 802. The surface junction between the bottom surface and the upper surface forms interface 808. The cutting face 806 is opposite the bottom surface of the ultrahard layer 804. The cutting face 806 typically has a flat or planar surface.

As shown, body 802 is generally cylindrical along a longitudinal axis A. Thus, a cross-section of body 802 is generally circular. In contrast, cutting face 806 has an irregular cross-section. Thus, the cross-section of cutting face 806 is non-circular. As shown, cutting face 806 may include two or more lobes 812. The length of a chord 820 of the cutting face 806 is smaller than the length of a corresponding chord 822 of the body 802. More specifically, the length of a chord 820 of a lobe 812 of the cutting face 806 is smaller than the length of a corresponding chord 822 of the body 802. In one embodiment, the chord 820 of the cutting face 806 may be between 50 and 90 percent of the corresponding chord 822 of the body 802. In another embodiment, chord 820 of the cutting face 806 may be between 55 and 80 percent of the corresponding chord 822 of body 802. Chord 820 may be taken along a line parallel to a line tangent to cutting tip 816. Corresponding chord 822 of the body 802 may be taken along the same parallel line and measures the length of the chord of the cylindrical body 802.

The two or more lobes 812 of cutter 802 form an irregular cutting face 806 perimeter. The perimeter of the cutting face 806 includes concave portions 810 and convex or slightly convex portions 814. As shown in FIGS. 8 and 9, a cutter in accordance with embodiments disclosed herein may include three lobes 812, defined by three concave portions 810 and three convex portions 814. Those of ordinary skill in the art will appreciate that while the PDC cutter shown in FIGS. 8 and 9 includes a cutting face 806 with three lobes 812, a cutting face in accordance with embodiments of the present disclosure may include two lobes, four lobes, or more without departing from the scope of embodiments disclosed herein. In this embodiment, the chord 820 of the cutting face 806 may be defined by a first transition point B between a first convex portion 814*a* and a concave portion 810 and a second transition point C between the concave portion 810 and a second convex portion 814*b*. The length of chord 820 of the cutting face is smaller than the length of chord 822 of body 802. In some embodiments, the length of chord 820 defined by first and second transition points B, C of cutting face 806 is between 50 and 90 percent of the length of chord 822 of body 802.

Figure 10B:
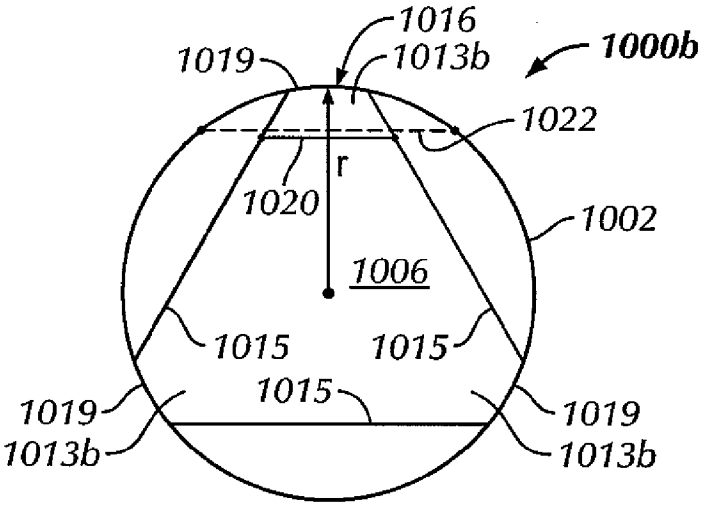
FIGS. 10A-10C show PDC cutters formed in accordance with embodiments disclosed herein.
Figure 10C:
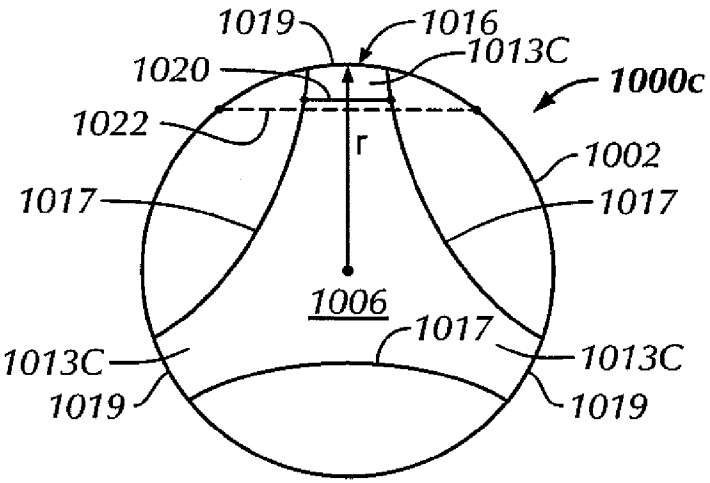
Figure 10A:
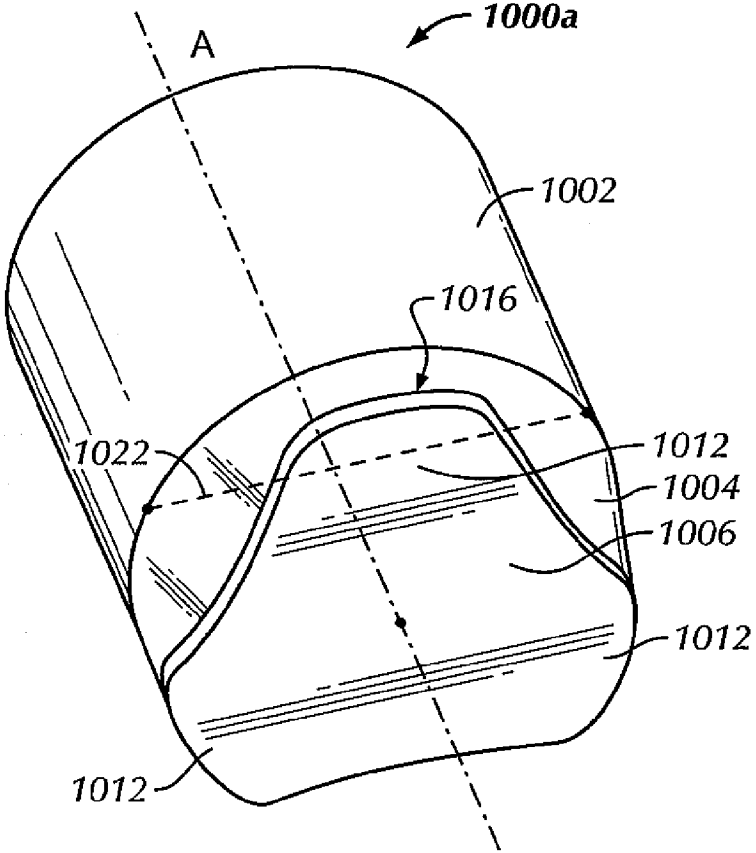

Referring now to FIGS. 10A-C, PDC cutters 1000*a*, 1000*b*, and 1000*c* having various cutting face geometries formed in accordance with embodiments of the present disclosure are shown. As shown, cutter 1000*a* includes a body 1002, an ultrahard layer 1004 disposed thereon, and a cutting face 1006 formed on a distal end of the ultrahard layer 1004. As discussed above, the body 1002 may be formed from any substrate material known in the art and the ultrahard layer 1004 may be formed from any ultrahard material known in the art. The cutting face 1006 is perpendicular to longitudinal axis A of the body 1002 and may be substantially planar. As shown, the body 1002 is cylindrical, and thus has a circular cross-section. In contrast, the cutting face 1006 has an irregular cross-section. In other words, the cross-section of the cutting face 1006 is not the same as the cross-section of the body 1002. The cutting face 1006 of the cutter 1000 includes two or more lobes 1012 or, as shown in better detail in FIGS. 10B and 10C, two or more truncated lobes 1013. As used herein, a truncated lobe 1013 is a projection or division that may or may not be rounded. The truncated lobe 1013 may include a curved portion or arc, but may not form a continuously smooth or rounded edge. For example, as shown in FIG. 10B, cutter 1000*b* includes a cutting face 1006 having three truncated lobes 1013*b*. Truncated lobes 1013*b* are joined by straight portions 1015, thereby forming a relatively sharp junction with an arced end 1019 of the truncated lobe 1013*b*. In an alternative embodiment, shown in FIG. 10C, truncated lobes 1013*c* of cutter 1000*c* are joined by convex portions 1017. Similarly, convex portions 1017 form a relatively sharp junction with arced end 1019 of the truncated lobe 1013*c*.

Each lobe or truncated lobe 1012, 1013 may be defined by a chord 1020. A length of the chord 1020 of cutting face 1016 is smaller than a length of a corresponding chord 1022 of the body 1002. Chord 1020 of cutting face 1016 may be taken along a line parallel to a line tangent to a cutting tip 1016 of the cutter 1000. Corresponding chord 1022 of the body 1002 is taken along the same line parallel to the line tangent to the cutting tip 1016. In some embodiments, the length of chord 1020 of cutting face 1006 is 50 to 90 percent of the length of the corresponding chord 1022 of the body 1002. In certain embodiments, the length of chord 1020 of cutting face 1006 is 55 to 80 percent of the length of the corresponding chord 1022 of the body 1002. As shown in FIGS. 10B and 10C, the radius r of the truncated lobe 1013 may be equal to the radius of the body 1002, while the chord 1020 of the truncated lobe 1013 is less than the corresponding chord 1022 of the body 1002.

Advantageously, embodiments disclosed herein may provide for a PDC cutter that may be reused after being worn. In particular, embodiments disclosed herein may provide a PDC cutter that may be turned or rotated during remanufacturing to provide a second or third cutting tip configured to contact a formation. Additionally, embodiments disclosed herein may provide a cutter for use on a drill bit to provide a higher ROP than available through the use of conventional cutters. PDC cutters formed in accordance with the present disclosure may also provide a wear surface that does not increase in width as quickly as the wear surface of a conventional cutter. Further, embodiments disclosed herein may provide a cutter that maintains ROP during drilling of the formation for longer time periods than a conventional cutter, e.g., the ROP of the bit does not drop as quickly during drilling as with a conventional cutter.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A polycrystalline diamond compact ("PDC") cutter comprising:

a cylindrical body formed from a substrate material;

an ultrahard layer disposed on the cylindrical body; and a cutting face perpendicular to a longitudinal axis of the cylindrical body, the cutting face including three lobes that form a planar surface that is perpendicular to the longitudinal axis of the cylindrical body, the three lobes defined by three substantially concave portions and three convex portions with respect to the longitudinal axis of the cylindrical body, wherein the radius of at least one lobe is between 50 and 90 percent of the radius of the cylindrical body, wherein the ultrahard layer comprises a transition section having a non-circular cross -section, the transition section extending from a circular cross-section of the cylindrical body to a non-circular cross-section of the cutting face, wherein the transition section comprises a smooth profile along the axial length and along a perimeter of the transition section from the circular cross-section of the cylindrical body to the non-circular cross-section of the cutting face, and wherein the cross-sectional area of the transition section decreases with axial distance from the interface along a majority of the axial length of the transition section.

2. The PDC cutter of claim 1, wherein the cross-sectional area of the ultrahard layer increases with the axial distance from the cutting face toward to the cylindrical body.

3. The PDC cutter of claim 1, wherein the radius of at least one lobe is between 55and 83 percent of the radius of the cylindrical body.

4. The PDC cutter of claim 1, wherein the cutting face is planar.

5. A PDC cutter comprising:

a cylindrical body formed from a substrate material;

an ultrahard layer disposed on the cylindrical body; and a cutting face perpendicular to a longitudinal axis of the cylindrical body having at least two lobes forming an irregular cross-section, wherein a chord of at least one lobe, defined by two transition points between a concave portion and two convex portions, is smaller than a corresponding chord of the cylindrical body, wherein the ultrahard layer comprises a transition section extending from an interface between the cylindrical body and the ultrahard layer to the cutting face, and wherein a cross-sectional area of the transition section decreases with axial distance from the interface along an entire axial length of the transition section.

6. The PDC cutter of claim 5, wherein the chord of the at least one lobe is taken along a line parallel to a line tangent to a cutting tip of the cutting face.

7. The PDC cutter of claim 5, wherein the cross-section of the ultrahard layer transitions from an irregular cross-section at the cutting face to a circular cross-section at the cutter body.

8. The PDC cutter of claim 5, wherein a length of the chord of the at least one lobe is between 50 and 90 percent of a length of the corresponding chord of the cylindrical body.

9. The PDC cutter of claim 5, wherein a length of the chord of the at least one lobe is between 55 and 80 percent of a length of the corresponding chord of the cylindrical body.

10. A PDC cutter comprising:

a substrate;

an ultrahard layer disposed on the substrate; and a cutting face formed at a distal end of the ultrahard layer, wherein a perimeter of the cutting face comprises at least two lobes forming at least two convex portions and at least two concave portions with respect to a longitudinal axis of the substrate, wherein the cutting face is perpendicular to the longitudinal axis of the substrate, wherein the ultrahard layer comprises a transition section extending from an interface between the substrate and the ultrahard layer to the cutting face, and wherein a cross-sectional area of the transition section decreases with axial distance from the interface along an entire axial length of the transition section.

11. The PDC cutter of claim 10, wherein the cutting face is planar.

12. The PDC cutter of claim 10, wherein the substrate is cylindrical.

13. The PDC cutter of claim 12, wherein a chord of at least one lobe, defined by a first transition point disposed between a first convex portion and a concave portion, and a second transition point disposed between the concave portion and a second convex portion, is smaller than a chord of the cylindrical body.

14. The PDC cutter of claim 10, wherein the radius of at least one of the at least two concave portions is between 50 and 90 percent of the radius of the substrate.

15. A PDC cutter comprising:

a substrate;

a cutting face perpendicular to a longitudinal axis of the substrate, wherein the cross-section of the cutting face comprises multiple lobes defined by at least two convex portions and at least two concave portions with respect to the longitudinal axis of the substrate, and the cross-section of the substrate is substantially circular, and a transition section extending from the circular cross-section of the substrate to a non -circular cross-section of the cutting face, wherein the transition section comprises a smooth profile along the axial length and along a perimeter of the transition section from the circular cross-section of the substrate to the non-circular cross-section of the cutting face, and wherein the cross-sectional area of the transition section decreases with axial distance from the interface along a majority of the axial length of the transition section.

16. The PDC cutter of claim 15, further comprising an ultrahard layer disposed on the substrate, wherein the cutting face is formed on a distal end of the ultrahard layer.

* * * * *